US007347717B2

(12) United States Patent
Taylor

(10) Patent No.: US 7,347,717 B2
(45) Date of Patent: Mar. 25, 2008

(54) INSULATION DISPLACEMENT SYSTEM

(75) Inventor: Robert N. Taylor, Coventry, RI (US)

(73) Assignee: Illinois Tool Works, Glenview, IL (US)

( * ) Notice: Subject to any disclaimer, the term of this patent is extended or adjusted under 35 U.S.C. 154(b) by 0 days.

(21) Appl. No.: 11/402,630

(22) Filed: Apr. 12, 2006

(65) Prior Publication Data

US 2007/0243751 A1 Oct. 18, 2007

(51) Int. Cl.
*H01R 4/24* (2006.01)

(52) U.S. Cl. ..... 439/409

(58) Field of Classification Search ..... 439/409, 439/404–405, 579, 497, 417, 372, 352–358
See application file for complete search history.

(56) References Cited

U.S. PATENT DOCUMENTS 4,537,456 A * 8/1985 Brown et al. ..... 439/404
4,820,188 A 4/1989 Collier et al.
4,891,020 A 1/1990 Dunn
4,971,572 A 11/1990 Hopper
5,308,258 A * 5/1994 Hatsios ..... 439/284
5,399,098 A 3/1995 Marshall et al.
5,622,516 A 4/1997 Baggett et al.
5,624,274 A * 4/1997 Lin ..... 439/417
5,632,081 A 5/1997 Gerhard, Jr.
5,667,414 A 9/1997 Karacora
5,964,620 A * 10/1999 Takahashi et al. ..... 439/579
5,989,071 A 11/1999 Larsen et al.
6,019,627 A 2/2000 Embo et al.
6,074,237 A 6/2000 Lee
6,089,898 A * 7/2000 Lincoln et al. ..... 439/357
6,120,319 A 9/2000 Lee et al.
6,193,556 B1 2/2001 Escane
6,276,955 B1 8/2001 Hollensen et al.
6,280,230 B1 8/2001 Takase et al.
6,290,531 B1 9/2001 Onizuka et al.
6,296,514 B1 10/2001 Medina et al.
6,368,143 B1 4/2002 Adams
6,416,347 B2 7/2002 Kojima
6,468,103 B1 10/2002 Brower
6,729,899 B2 5/2004 Aekins et al.
6,761,576 B1 7/2004 Ye et al.
6,780,044 B1 8/2004 Sawyer et al.
6,835,089 B2 12/2004 Hayes et al.
6,953,362 B2 10/2005 Mossner et al.
2005/0233638 A1 10/2005 Taylor

* cited by examiner

*Primary Examiner*—J. F. Duverne

(57) ABSTRACT

An insulation-displacement system that comprises a first insulation-displacement terminal (IDT) adapted to receive in a mating configuration a second IDT. The first IDT comprises a first plate that includes a base edge, and a slot configured to receive an electrical conductor surrounded by an insulator and displace the insulator. The slot extends towards the center of the first plate from a second edge located opposite the base edge.

27 Claims, 7 Drawing Sheets

INSULATION DISPLACEMENT SYSTEM

TECHNICAL FIELD

This invention relates to insulation displacement systems, including insulation displacement systems used as a tap or splice.

BACKGROUND

Insulation displacement systems (IDS) provide a convenient way to establish an electrical connection between an electrical conductor and an electrical contact (e.g., an electric terminal, electric interface, a second electric wire, etc.).

A conventional IDS includes a terminal with an open slot extending from one edge of the terminal. A section of an electrical cable (which includes a single or multi-strand electrical conductor surrounded by an insulator) is directed into the slot in such a way that the longitudinal axis of the electrical cable and the longitudinal axis of the slot are substantially perpendicular. Typically, the width of the slot is narrower than the diameter of the conductor bundle. Thus, as the insulated cable is pressed into the slot, the edges of the slot cut into the insulation surrounding the electrical conductor(s) and displace the insulator, thereby exposing the electrical conductor(s). Additionally, as the exposed electrical conductor continues to travel into the slot, making contact with the electrically conducting edges of the slot, the substantially round shape of the conductor bundle is compressed into an oval shape, establishing an electric connection with the electrical contact.

SUMMARY

Disclosed herein is an insulation displacement system that includes a first insulation displacement terminal (IDT) adapted to receive in a mating configuration another IDT. In an embodiment, two such IDT's include slots that are each configured to receive a cable and displace the cable's insulation to expose the cable's conductor. In their mated configuration, the slots of the two IDT's are adjacent to each other but with opposite orientation to the wire bundle, and thus define a closed adjustable aperture that holds the conductors of the cable. This closed aperture maintains the wire bundle in a compressed state; the bundle cannot relax, for example, as a result of elastomenric deformation of the insulating jacket. The individual wires in the bundle cannot migrate up the throat (or open end) of the slot, as the slot is effectively capped by the adjacent terminals. In this fashion each terminal serves to support and cap the adjacent terminal. In addition, the slot of each terminal independently engages the wires of the bundle, thereby increasing the area of direct terminal-to-wire interface, which in turn facilitates current flow. Additionally, maintaining the wire bundle in a compressed state reduces the harmful effect of vibration. Also, when the wire bundle is designed to deliver power, maintaining the wire bundle in a compressed state enables a more even distribution of the power density amongst the wires of bundle.

In one aspect, the invention includes an insulation-displacement system that comprises a first insulation-displacement terminal (IDT) adapted to receive in a mating configuration a second IDT. The first IDT comprises a first plate that includes a base edge, and a slot configured to receive an electrical conductor surrounded by an insulator and displace the insulator. The slot extends towards the center of the first plate from a second edge located opposite the base edge.

In some embodiments, the insulation-displacement system further comprises the second IDT. The second IDT comprises a second plate that includes a base edge, and a slot configured to receive the electrical conductor and displace the insulator. The slot extends towards the center of the plate from a second edge located opposite the base edge. The surface of the plate of the first IDT is placed substantially adjacent to the surface of the plate of the second IDT, and the second edge of the second IDT is displaceable towards the base edge of the first IDT.

In some embodiments, the second edge of each plate of each of the IDT's is V-shaped, and each slot of the IDT's extends from the respective V-shaped edge.

In further embodiments, the slot of the first IDT and the slot of the second IDT are substantially adjacent such that the slots define a closed adjustable aperture configured to hold the electrical conductor.

In yet further embodiments, the plate of the second IDT further includes two substantially flat side edges, and the plate of the first IDT further includes two side edges formed to define tracks configured to receive the respective side edges of the second IDT. In some embodiments, the formed side edges of the first IDT are curved inwardly.

In some embodiments, each plate of each of the IDT's further includes an arc-shaped rib configured to prevent slot deformation.

In some further embodiments, each plate of each of the IDT's is substantially entirely constructed from an electrical conductive material.

In some other embodiments, each of the IDT's further includes a projection extending from the plate of the corresponding IDT. The projection is configured to electrically couple the corresponding IDT to an electrical contact. In some embodiments the projection of each of the IDT's is a blade that extends in a direction that is substantially perpendicular to surface of the corresponding plate. In further embodiments, the surfaces of the respective blades of the first IDT and the second IDT are positioned adjacent to each other such that the adjacently placed blades define a resultant blade having a thickness that is substantially the sum of the thickness of the respective blades of the first IDT and the second IDT.

In some embodiments, the resultant blade is configured to be received in an electrically conducting socket. In some embodiments, the socket is coupled to a crimp connector. In yet further embodiments, the socket comprises a female fastener configured to maintain the resultant blade within the socket.

In some embodiments, the first IDT further comprises a folded blade extending from the first plate, the folded blade comprising at least one pivotable plate extending from an end of the blade proximate to the first plate such the at least one pivotable plate and the first plate define a passage for receiving a side edge of the second plate of the second IDT.

In further embodiments, the first IDT further includes a rolled receiver configured to fixture and lock the second IDT.

In another aspect, the invention includes a method for electrically coupling an electrical conductor surrounded by an insulator to an electrical contact. The method comprises providing an insulation-displacement device that includes a first insulation-displacement terminal (IDT) and a second IDT, each of the IDT's comprising a plate that includes a base edge, and a slot configured to receive the electrical conductor and displace the insulator, the slot extends towards the center of the plate of the IDT from a second edge located opposite of the base edge. The surface of the plate of the first IDT is placed substantially adjacent to the surface of the plate of the second IDT, and the second edge of the second IDT is displaceable towards the base edge of the first IDT. The method further comprises placing the electrical conductor in the slots of the adjacently placed plates of the first IDT and the second IDT, displacing the second IDT plate so that the second edge of the second IDT moves towards the base edge of the first IDT to thereby displace the insulator of the electrical conductor and to decrease the size of a closed adjustable aperture defined by the slots, and connecting the adjacently placed plates of the IDT's to the electrical contact.

In another aspect, the invention includes an electrical tap connector comprising a first insulation-displacement terminal (IDT) adapted to receive in a mating configuration a second IDT, each of the IDT's comprises an electrically conducting member, and the mated first IDT and the second IDT are configured to electrically couple to a first electrical conductor surrounded by an insulator. The electrical tap connector further comprises an electrically conducting receiver electrically coupled to a second electrical conductor, the receiver is configured to receive, for example, the member of the first IDT, and/or the member of the second IDT.

In a further aspect, the invention includes a method for splicing a first electrical conductor surrounded by an insulator and a second electrical conductor. The method comprises providing an insulation-displacement system comprising a first insulation-displacement terminal (IDT) adapted to receive in a mating configuration a second IDT, each of the IDT's comprises an electrically conducting member, and the mated first IDT and the second IDT are configured to electrically couple to the first electrical conductor. The method further comprises electrically coupling the first electrical conductor to the insulation-displacement device, placing at least one of the member of the first IDT and the member of the second IDT in an electrically conducting receiver, and electrically coupling the receiver to the second electrical conductor.

The details of one or more embodiments of the invention are set forth in the accompanying drawings and the description below. Other features, objects, and advantages of the invention will be apparent from the description and drawings, and from the claims.

DESCRIPTION OF THE DRAWINGS

Like reference symbols in the various drawings indicate like elements.

DETAILED DESCRIPTION

Figure 1:
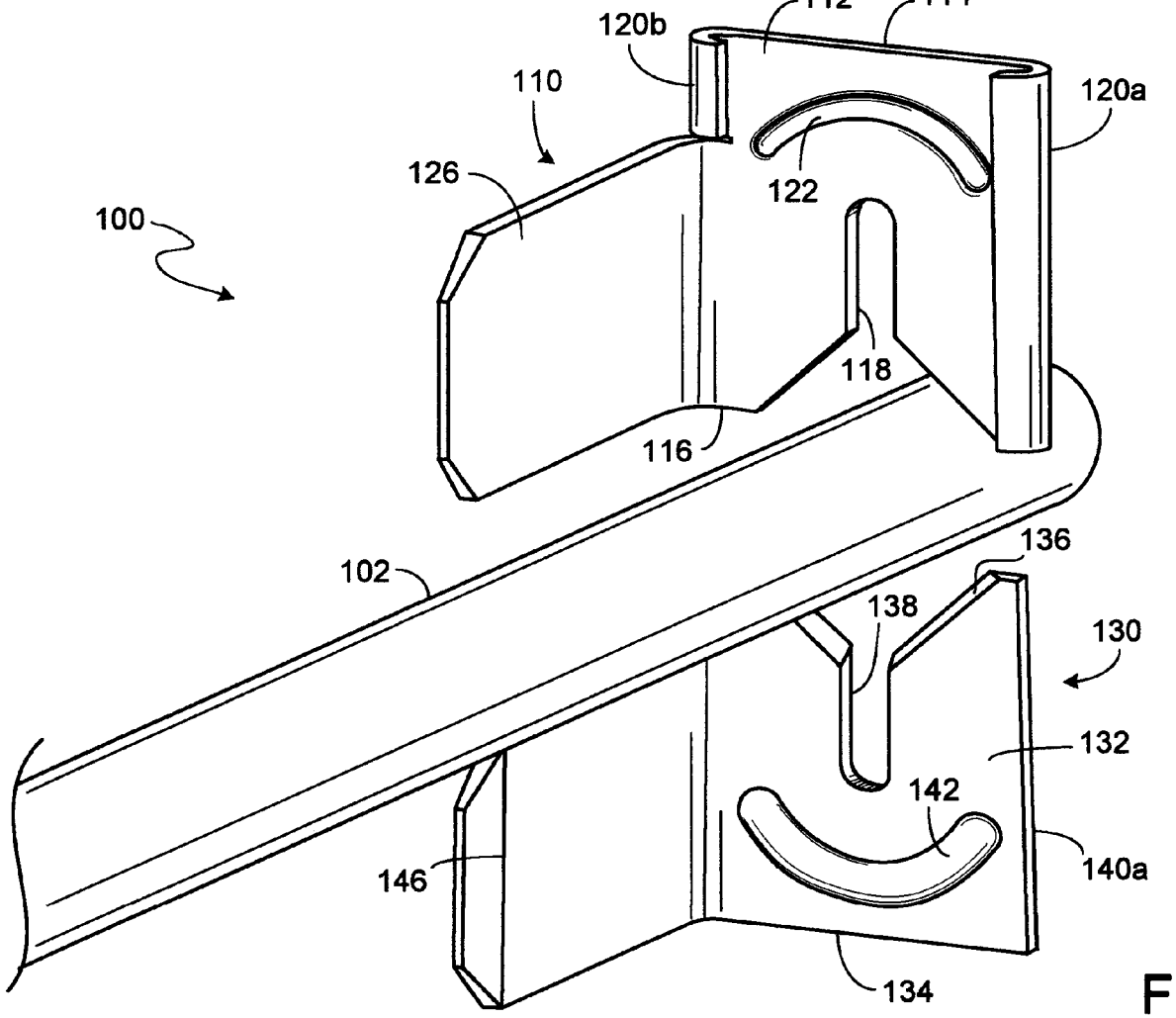
FIG. 1 is a perspective view of an exemplary embodiment of an insulation displacement system.

FIG. 1 is a perspective view of an exemplary embodiment of an insulation displacement system 100 used to establish an electric connection between an electric cable 102 that includes a single or multi strand electrical conductor surrounded by an insulator, and an electrical contact such as a crimp terminal (not shown). The electrical conductor may include one or more electrical wires configured to deliver electrical power or electrical/electronic signals.

The insulation displacement system 100 includes a first insulation displacement terminal (IDT) 110 that includes a plate 112. As shown in FIG. 1, the plate 112 has a substantially flat rectangular configuration, and is composed substantially entirely from an electrically conducting material (e.g., copper, aluminum).

The plate 112 has a base edge 114, and a second edge 116 that is located opposite the base edge 114. A slot 118 extends from the second edge 116 towards the center of the plate 112. In some embodiments, the second edge 116 of the plate 112 is V-shaped, thus enabling the cable to be easily guided along the contour of the second edge 116 towards the opening of the slot 118. In such embodiments, the slot 118 extends from the V-shaped edge. The second edge 116 may have other shapes and/or configurations.

The slot 118 is configured to receive the electrical cable 102 and to displace the insulation surrounding the conductor of the cable 102. Particularly, the outside surface of a section of the insulator of the electric cable 102 is directed into the slot, for example by applying sufficient force on the cable to press it into the slot. The edges of the slot 118, which are electrically conducting, then slice and penetrate into the insulator of the cable 102. As a result, the edges of the slot 118 impede the movement of the cable along the slot. Consequently, as mechanical force continues to be applied on the cable 102, the edges of the slot 118 cause the insulator to be separated from the electrical conductor inside the insulator. The section of the insulation layer of the cable 102 received in the slot 118 is thus displaced, and the electrical conductor is exposed.

As further shown in FIG. 1, the first IDT 110 is adapted to receive in a mating configuration a second IDT, such as IDT 130. In some embodiments, the second IDT 130 includes a substantially rectangular flat plate 132 composed substantially entirely of an electrical conducting material. The second plate 132 of the second IDT 130 includes a base edge 134 and a second edge 136. A slot 138 extends from the second edge 136 towards the center of the second plate 132. The edges defining the slot 138 are electrically conducting. In some embodiments the second edge 136 of the second IDT 130 is V-shaped, and the slot 138 extends from the V-shaped edge towards the center of the second plate 132.

To receive the second IDT 130 in a mating configuration, the second edge 136 of the plate 132 of the second IDT 130 is aligned to receive another section of the cable 102. That other section of the cable 102 is located substantially opposite the side of the cable 102 having the section that was received by the slot 118 of the first IDT 110. Thus, for example, in FIG. 1 the first IDT 110 is positioned so that the slot 118 of the first IDT 110 is aligned to receive the top surface of a section of the cable 102. The second IDT 130, on the other hand, is positioned so that its slot 138 is aligned to receive the bottom surface of a substantially adjoining or overlapping section of the electric cable 102.

Figure 2:
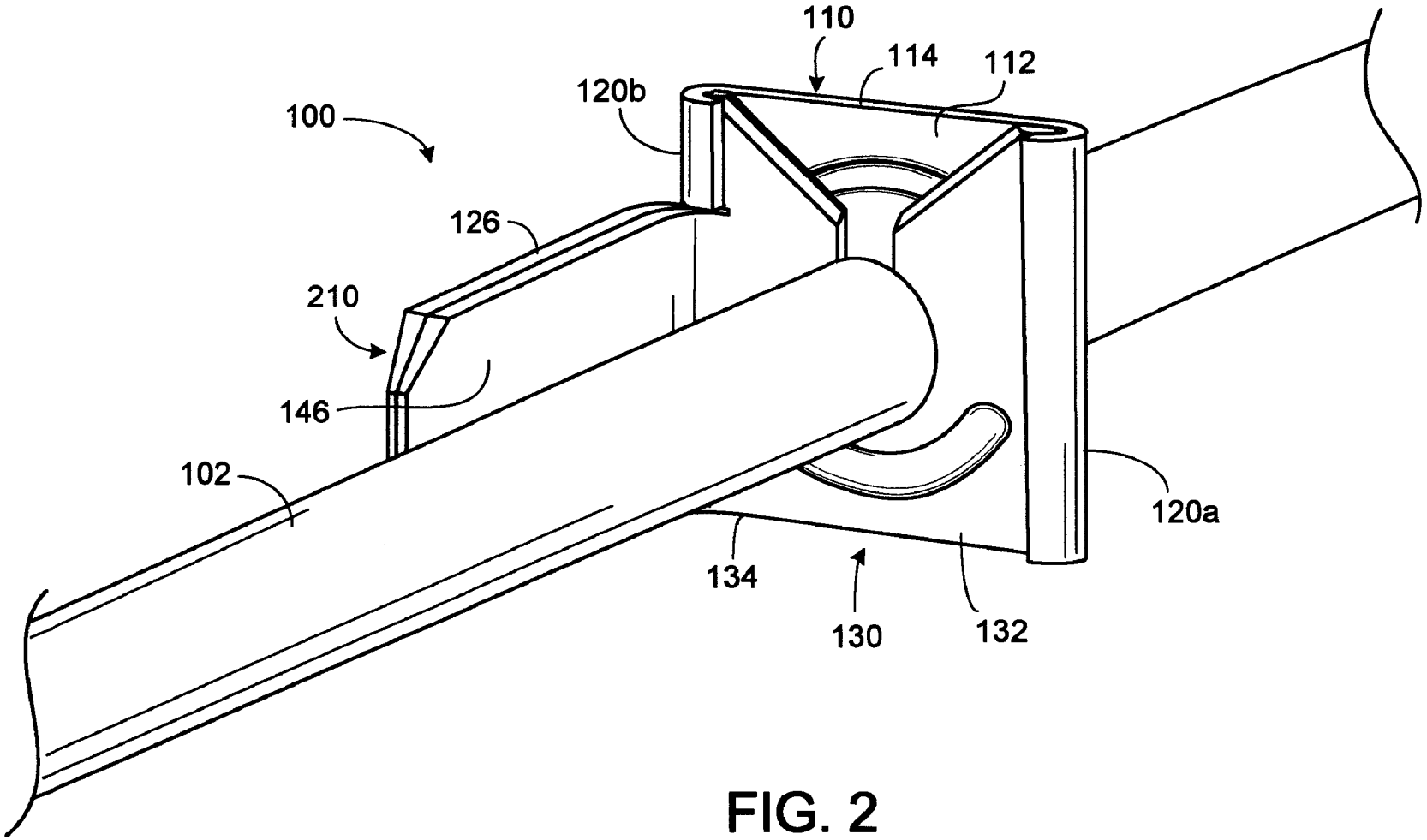
FIG. 2 is a perspective view of the insulation displacement system of FIG. 1 in which the insulation displacement terminals are in their mated position.

With reference to FIG. 2, to mate the first IDT 110 with the second IDT 130, the surface of the plate 112 of the first IDT 110 is placed substantially adjacent to the surface of the plate 132 of the second IDT 130. The displaceable second edge 136 of the second IDT 130 is displaced towards the base edge 114 of the first IDT 110. As the second edge 136 is displaced towards the base edge 114 of the first IDT 110, the edges of the slot 138 of the second IDT 130 slice the insulator at the bottom surface of the cable 102, and thus cause the sliced insulator to be displaced.

Figure 3:
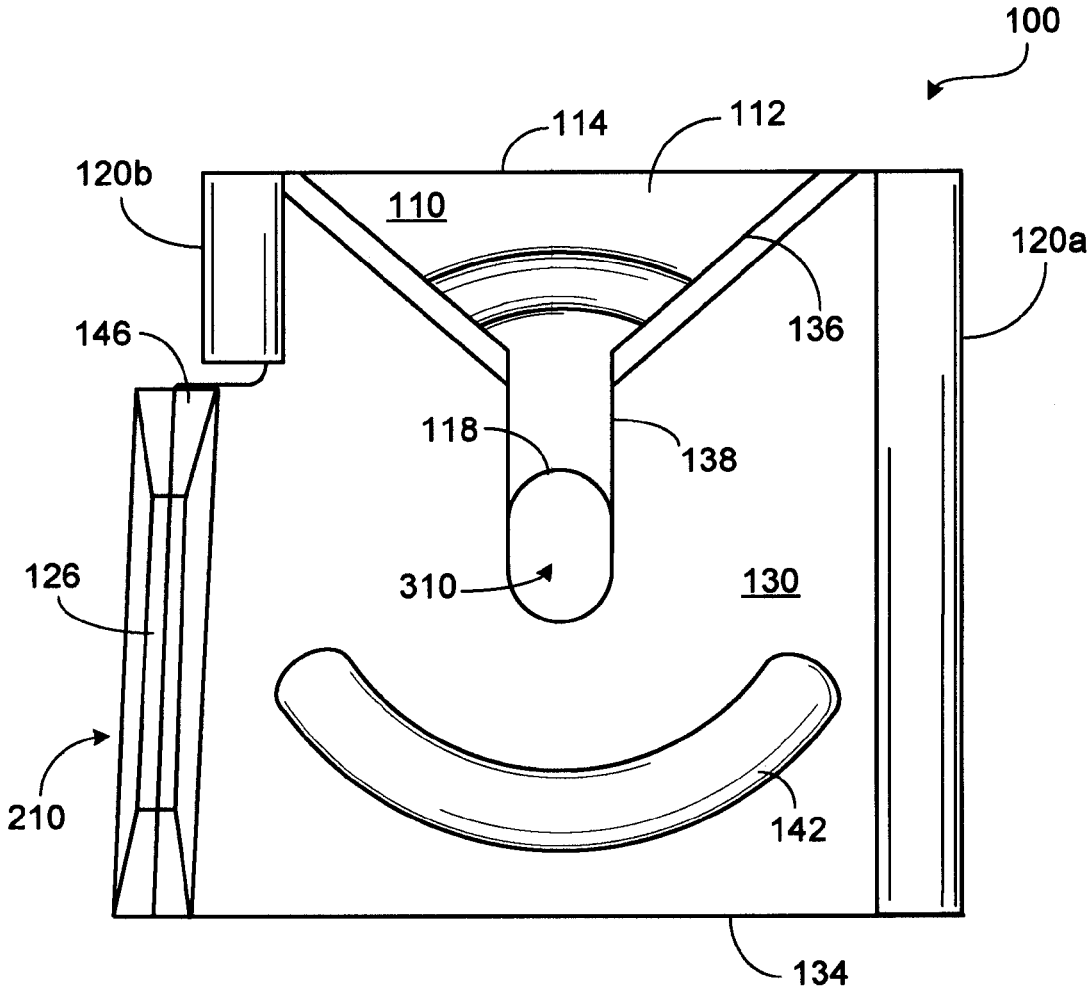
FIG. 3 is a front view of the insulation displacement system shown in FIG. 2.

With reference to FIG. 3, in their mated position the slot 118 of the first IDT 110 and the slot 138 of the second IDT 130 define a closed adjustable aperture 310 that holds the conductor(s) of the electric cable 102. The dimensions of the aperture are adjusted by controlling the extent of the displacement of one plate of one IDT relative to the plate of the other IDT. Thus, for example, the dimensions of the closed aperture 310, as shown in FIG. 3, may be increased by displacing the second edge 136 of the second IDT 130 away from the base edge 114 of the first IDT 110. By adjusting the dimensions of the closed adjustable aperture 310, the conductors of the cable 102 are confined into a closed space, thereby causing loosely bundled conductors (e.g., electrical wires) to be more tightly bundled, thus establishing a more robust electrical connection and better current flow between the conductor of the cable 102 and the electrical contact to which the insulation displacement system 100 is connected.

With reference to FIGS. 1, 2 and 3, to facilitate displacing the plates of the respective IDT's into a mating position, the first IDT 110 includes two side edges 120*a* and 120*b* that are formed to define tracks configured to receive the side edges 140*a* and 140*b* of the second IDT 130. The side edges 140*a* and 140*b* of the second IDT 130 are substantially flat and fit into the tracks defined by the formed side edges 120*a* and 120*b* of the first IDT 110. As shown in FIGS. 1, 2 and 3, the formed side edges 120*a* and 120*b* of the first IDT 110 are curved inwardly. However, the side edges 120*a* and 120*b* may be formed to define tracks having other configurations. Further, the side edges 140*a* and 140*b* of the second IDT 130 may similarly be formed to define tracks configured to receive the side edges of the first IDT 110.

As further shown in FIGS. 1, 2 and 3, the first IDT 110 and the second IDT 130 may include respective stiffening ribs, shown arc-shaped 122 and 142, configured to prevent slot deformation of the respective slots 118 and 138 when the slots receive the cable 102. The stiffening arc-shaped ribs 122 and 142 of the respective plates 112 and 132 counteract the force exerted on the edges of the slots 118 and 138 by the cable 102. The stiffening ribs 122 and 142 thus increase the durability of the plates 112 and 132 of the IDT's 110 and 130, respectively. As shown in FIG. 3, the arc-shaped ribs on the plates of the mated IDT's 110 and 130 protrude outwardly such that the adjacent surfaces of the mated plates 112 and 132 include the indentation defined by the stiffening ribs 122 and 142.

As further shown in FIGS. 1 and 2, the IDT's 110 and 130 include respective members, or projections, 126 and 146 that are configured to couple the respective IDT's to the electrical contact. Projections 126 and 146 are each electrically conductive members that extend outwardly from the respective plates 112 and 132. The projections 126 and 146 are electrically coupled to the electrically conducting edges of the slots 118 and 138, respectively, and thus are electrically coupled to the conductor of the cable 102 received in the slots.

In the embodiment shown in FIGS. 1, 2 and 3, each of the projections 126 and 146 is a blade, having substantially flat surfaces, that extends from one of the side edges of the respective plates 112 and 132 in a direction that is substantially perpendicularly to the surfaces of the plates. Specifically, the projection 126 extends substantially perpendicularly from the surface of plate 112 that includes the arc-shaped indentation. The projection 146, on the other hand, extends substantially perpendicularly from the surface of the plate 132 of the second IDT 130 that includes the arc-shaped stiffening rib 142. Thus, when the IDT's 110 and 130 are placed in their mated position, the projections 126 and 146 are positioned substantially adjacent to each other such that they define a resultant blade 210 (seen in FIG. 2) having a thickness that is substantially the sum of the thickness of the blades 126 and 146. Further, in the embodiment of the insulation displacement system 100 shown in FIGS. 1, 2, and 3, only a portion of the side edge 120*b* from which the blade 126 extends is formed to define a track that receives a corresponding side edges of the plate 132 of the second IDT 130.

Thus, in operation, a section on one side of the cable 102 is received in the slot 118 of the first IDT 110. Mechanical forces applied either to the cable 102 or to the first IDT 110 cause the received section of the cable 102 to be directed towards the end of the slot 118. The edges of slot 118 slice the insulation of the cable 102 and displace the insulation towards the opening of the slot (i.e., in a direction opposite the direction in which the cable is moving in the slot 118).

A second IDT 130 is positioned so that its slot 138 can receive another section of the cable 102 on the side of the cable that is substantially opposite where the first section of the cable was received by the slot 118 of the first IDT 110. Mechanical forces are applied either to the cable 102 or to the second IDT 130 to cause the second section of the cable to be directed along the slot 138 of the second IDT 130. The edges defining the slot 138 pierce the insulation of the cable 102, and cause the insulation to be displaced towards the opening of the slot 138.

The first IDT 110 and the second IDT 130 are positioned so that the second IDT 130 is received in a mating configuration by the first IDT 110. Particularly, the side edges 140*a* and 140*b* of the second IDT 130 are received in tracks defined by the side edges 120*a* and 120*b* of the first IDT 110. The second IDT 130 is displaced relative to the first IDT 110 such that the second edge 136 of the second IDT 130 moves towards the base edge 114 of the first IDT 110. As the plates are displaced relative to each other the insulator of the cable 102 is displaced.

Once the first IDT 110 and the second IDT 130 are in their mated positions, their respective slots 118 and 138 define a closed adjustable aperture that holds the exposed conductors of the cable 102 in a confined space, thereby enabling the conductor to establish a strong electrical connection with the electrical conducting edges of the slots 118 and 138, thus establishing a strong electrical connection with the electrical contact connected to the insulation displacement system 100.

Figure 4:
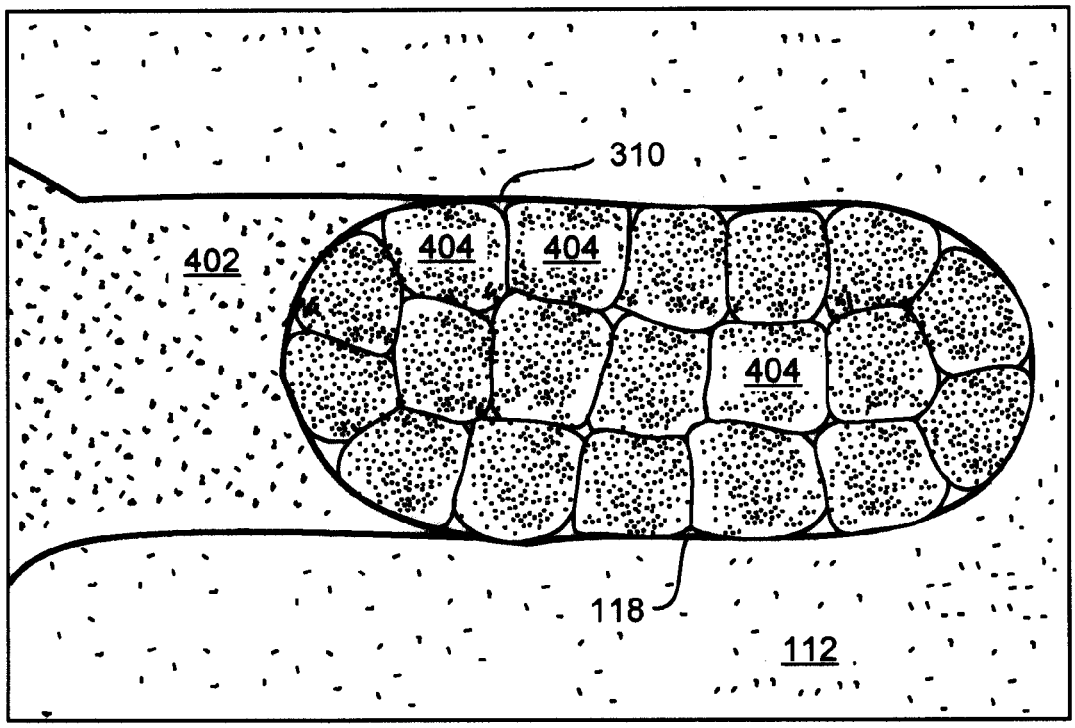
FIG. 4 is a cross-sectional view of the area around the closed aperture formed by the insulation displacement system of FIGS. 1, 2, and 3.

FIG. 4 shows a cross-sectional view of the area around the closed adjustable aperture 310 of the insulation displacement system 100 of FIGS. 1, 2, and 3. As can be seen, the insulation layer 402 of the cable 102 has been displaced, thus exposing the conductors 404. As shown, the slot 118 of the first IDT 110 and the slot 138 (not shown in FIG. 3) of the second IDT 130 define the closed adjustable aperture 310 that keeps the conductors 404 tightly bundled, and thus facilitate the formation of a strong electrical connection between the conductor 404 and the electrically conducting edges of the slots 118 and 138.

Figure 5:
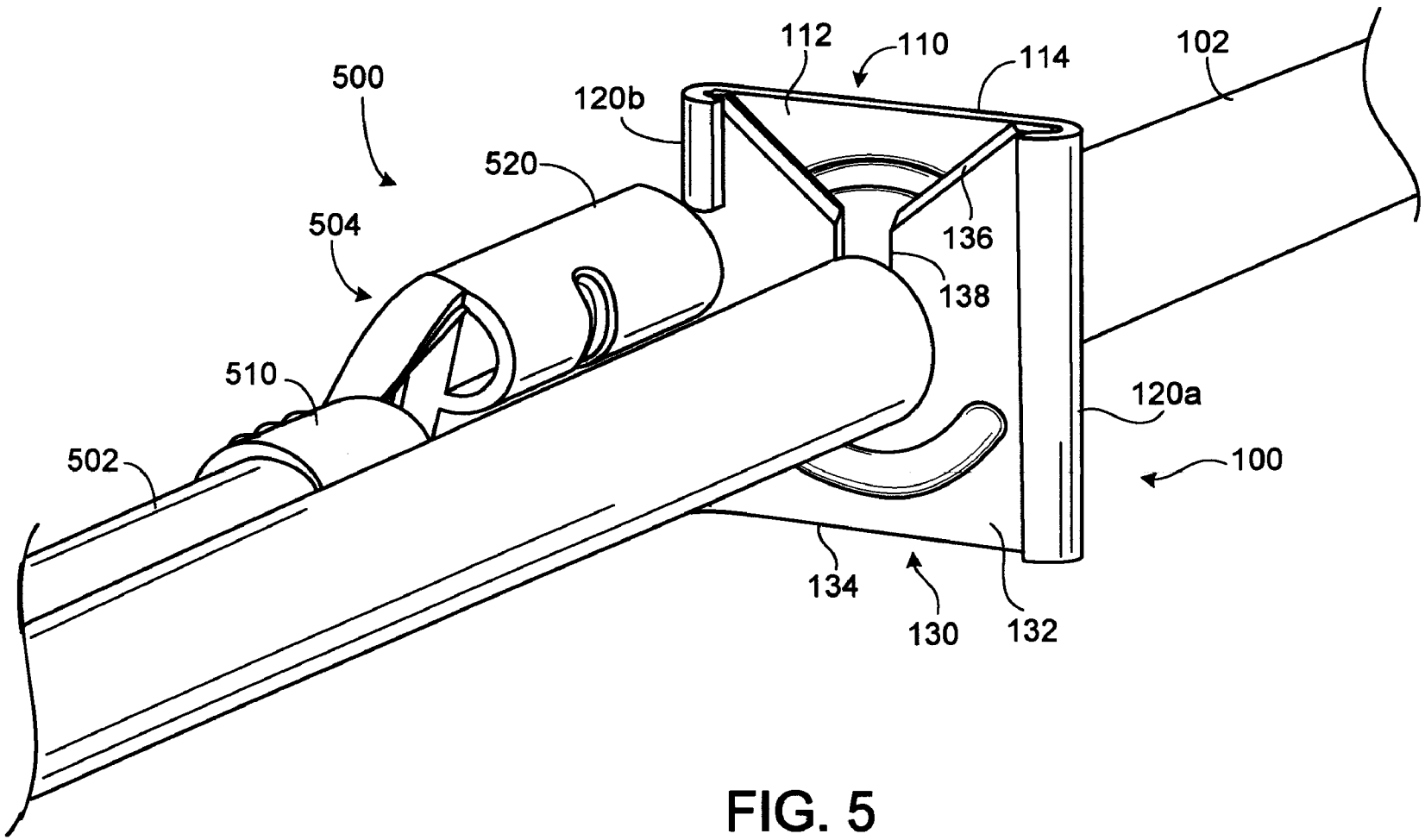
FIG. 5 is a perspective view of an exemplary embodiment of an electrical tap connector that uses the insulation displacement system shown in FIGS. 1, 2 and 3.

FIG. 5 shows a perspective view of an exemplary embodiment of an electrical tap connector 500 that uses an insulation displacement system such as system 100 shown in FIGS. 1, 2 and 3. The electrical tap connector 500 may be used to electrically connect one or more conductors in one cable to one or more conductors of another cable, in effect splicing the two cables. As shown, the electrical tap connector 500 includes an insulation displacement system such as IDS 100. As provided herein, the insulation displacement system 100 includes a first and second insulation terminal 110 and 130 placed in a mating configuration such that their respective slots 118 and 138 define a closed adjustable aperture that holds the conductor of the cable 102 in place. The operation of the insulation displacement system 100 causes the insulator at the section of the cable 102 located substantially in the space defined by closed aperture 310 (shown in FIG. 3) to be displaced, thus enabling the exposed conductor to establish a strong and reliable electrical connection with the electrical conducting edges of the slots 118 and 138.

As shown, the electrical tap connector 500 includes a crimp connector 504 configured to receive the electrical conductor(s) of a second cable 502, and establish an electrical connection between the conductors of the second cable 502 and the conductor of the electrical cable 102 that is electrically coupled to the insulation displacement system 100.

Figure 6:
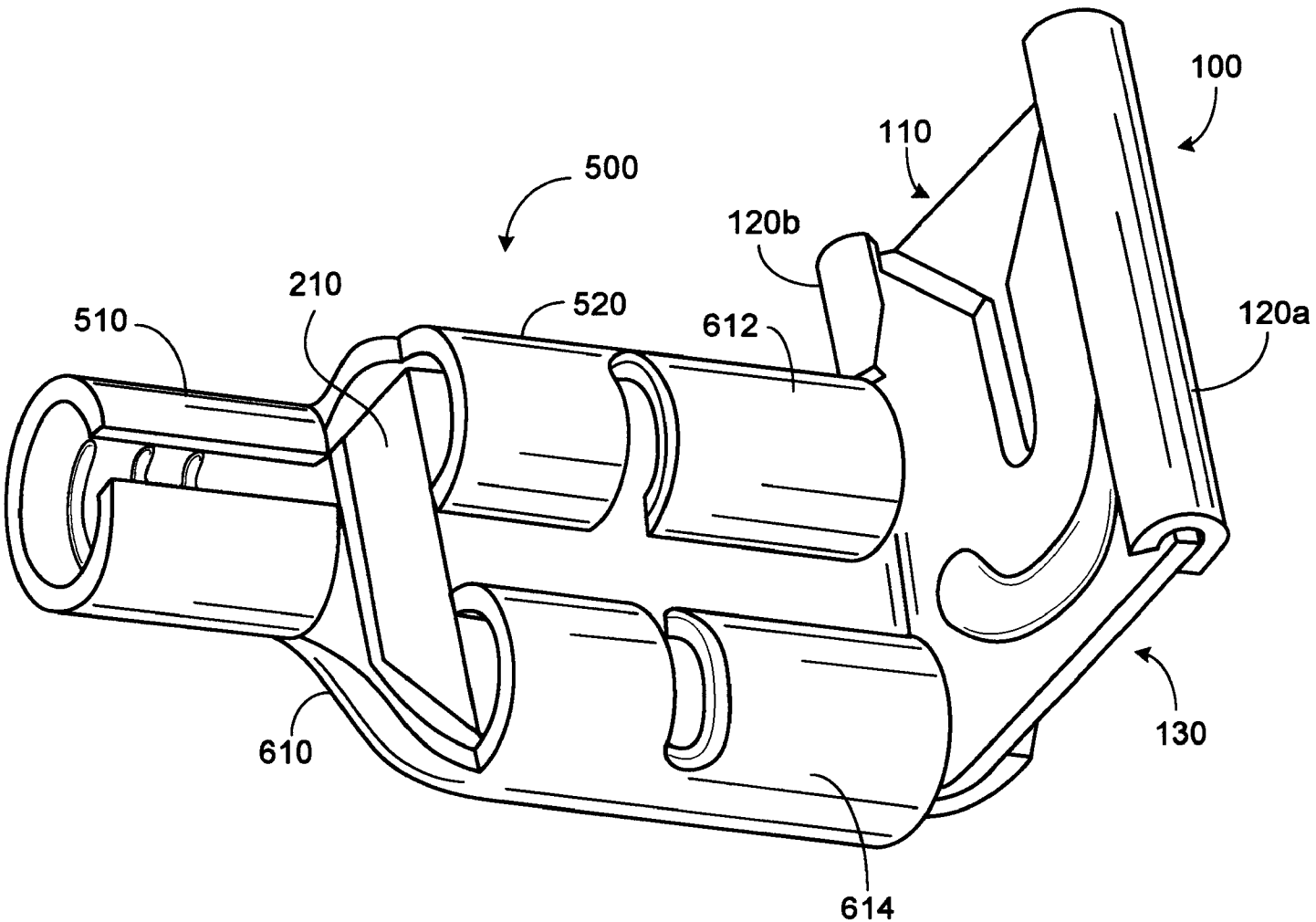
FIG. 6 is a perspective view of the electrical tap connector shown in FIG. 5 mated with a female connecting terminal.

With reference to FIG. 6, showing another perspective view of the electrical tap connector 500, the crimp connector 504 includes a crimp barrel 510 and an electrically conducting receiver such as a socket 520 which is electrically and mechanically connected to the crimp barrel 510. The crimp barrel 510 is configured to receive the conductors of the second cable 502 (shown in FIG. 5). When the conductors of the cable 502 are received in the crimp barrel 510, a crimping force is applied to the barrel, thereby causing the electrically conducting walls of the crimp barrel 510 to inwardly contract and establish an electrical connection between the conductors of the cable 502 and the internals electrical conducting walls of the crimp barrel 510. Other types of connectors and/or adapters configured to receive and establish an electrical connection with electrical conductors may be used instead of the crimp barrel.

The socket 520 includes a socket base 610, an upper rolled-rail fastener 612 that extends from a first side of the socket base 610, and a lower rolled-rail fastener 614 that extends from the side opposite the first side of the socket base 610. The upper rolled-rail fastener 612, lower rolled-rail fastener 614, and the socket base 610 define a slot that is configured to receive an electrical conducting blade, such as the resultant blade 210. Other types of fasteners (e.g., female fasteners) may be used to receive the electrical conducting projections extending from the IDS.

As shown in FIG. 6, the resultant blade 210, formed from the adjacent placement of the respective electrical conducting blades 126 and 146 of the first and second IDT's 110 and 130, is received in slot of the socket 520 of the crimp connector 504. The upper rolled-rail fastener 612 and the lower rolled-rail fastener 614 are configured to hold the blade 210 within the socket 520 by exerting spring forces on the blade 210.

Although FIGS. 5 and 6 show an exemplary embodiment of a crimp connector that is used with the electrical tap connector 500, other crimp connectors may also be used. Examples of suitable crimp connectors are described in U.S. patent application Ser. No. 10/828,156, filed Apr. 20, 2004 and entitled "Crimp Connector", the contents of which are hereby incorporated by reference in their entirety. Furthermore, other type of connectors, such as ring or fork terminal, PCB mounts, etc., which are configured to establish an electrical connection between a conductor and another electrical contact, may also be used. Further, although the exemplary embodiment of FIGS. 5 and 6 shows that the electrical connection between the insulation displacement system 100 and the crimp connector 504 is established by inserting the blade 210 into the socket 520 of the crimp connector 504, the electrical connection may be established by inserting only one of the electrical projections 126 or 146 into the socket 520.

Thus, in operation, an insulation displacement system, such as system 100, is used to electrically couple the conductor of the cable 102 to the insulation displacement system 100. At least one of the electrical conducting blades 126 and/or 146 is placed in an electrically conducting receiver, such as the socket 520 of the crimp connector 504 shown in FIGS. 5 and 6. The socket 520 is electrically and mechanically coupled to the crimp barrel 510 that receives the second electrical cable 502. The conductor(s) of cable 502 is received in the crimp barrel 510, and is maintained in the crimp barrel 510 by applying crimping force to the crimp barrel 510 to cause the walls of the crimp barrel to contract, and thus form a tight connection with the conductor of the cable 502. Thus, an electrical connection is established between the conductors of cable 502 and the conductors of cable 102, causing the conductors of the two cables to become, in effect, spliced.

Figure 7:
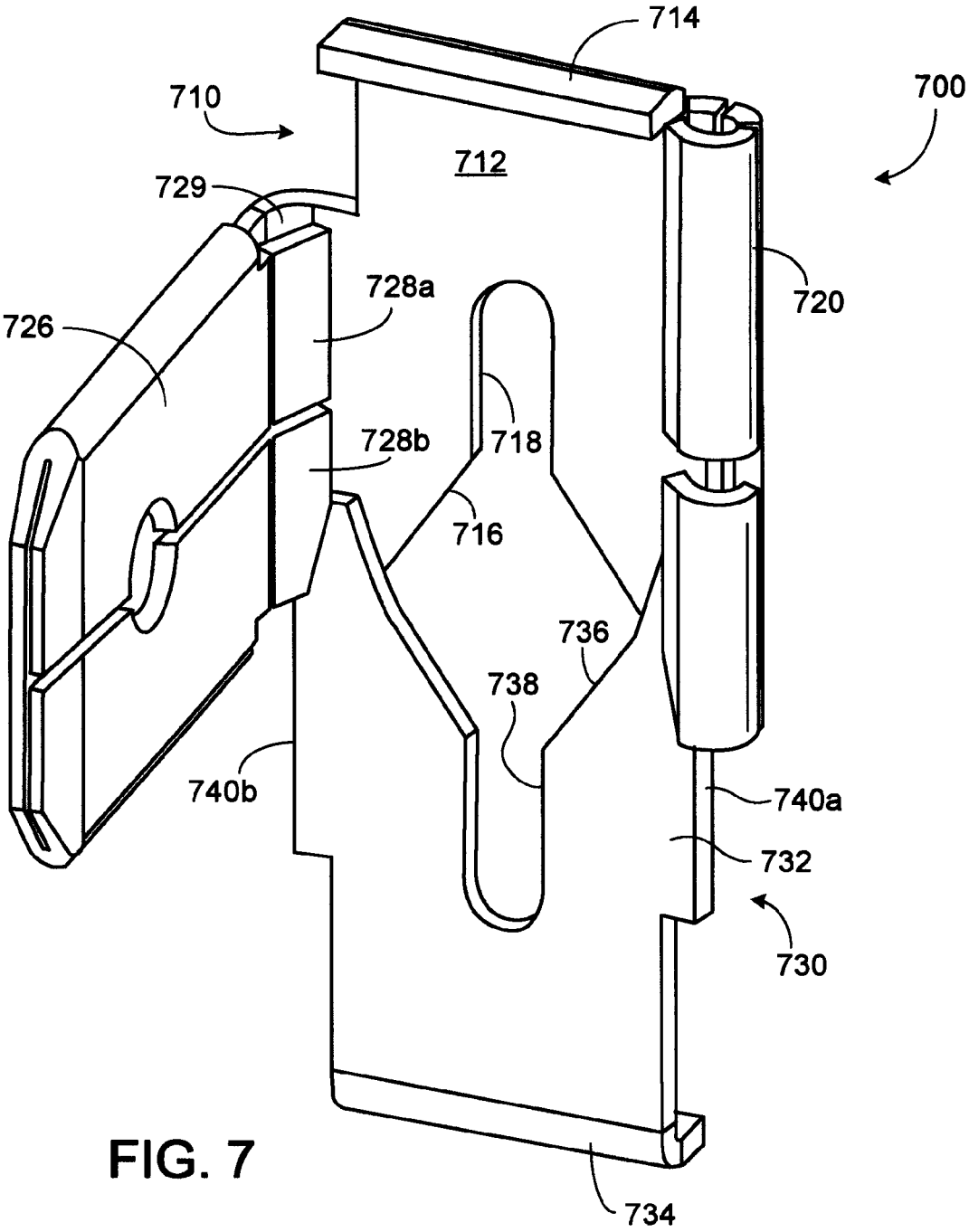
FIG. 7 is a perspective view of another embodiment of an insulation displacement system.

FIG. 7 shows another embodiment of an insulation displacement system that is configured to maintain its mated IDT's in a mechanically stable formation. As shown, an insulation displacement system (IDS) 700 includes a first insulation displacement terminal 710 having a plate 712. The plate 712 has a base edge 714, and a second edge 716 that is located opposite the base edge 714. A slot 718 that is configured to receive an electrical cable extends from the second edge 716 towards the center of the plate 712. In some embodiments the base edge 714 is bent so that it forms an angled portion with respect to the plate 712. The bent base edge facilitates pushing the IDT 710 against the cable received in the slot 718. In some embodiments the second edge 716 of the plate 712 is V-shaped to enable the cable to be easily guided along the contours of the second edge 716 towards the opening of the slot 718.

The IDT 710 is adapted to receive in a mating configuration a second IDT, such as IDT 730. The second IDT 730 includes a flat plate 732 that includes a base edge 734 and a second edge 736. In some embodiments the base edge 734 is bent so that it forms an angled portion with respect to the plate 732. A slot 738 extends from the second edge 736 towards the center of the plate 732. The edges defining the slot 738 are electrically conducting. In some embodiments the second edge 736 of the second IDT 730 is V-shaped, and the slot 738 extends from the V-shaped edge towards the center of the second plate 732.

To facilitate displacing the plates of the respective IDT's into their mating positions, the first IDT 710 includes a rolled receiver 720 that defines a passage or channel for receiving side edge 740*a* of the second IDT 730. The rolled receiver 720 is configured to fixture and lock the second IDT 730 near the side edge 740*a* when the two IDT's 710 and 730 are placed in their mated configuration, thereby providing stable mechanical contact between the first IDT 710 and the second IDT 730.

As further shown in FIG. 7, the first IDT also includes a projection 726 which is shaped as a blade and is configured to form an electrical connection with an electrical contact (not shown) such as a socket. As can be seen, the projection 726 is formed by folding a flat sheet extending from the plate 712 to form the resultant folded projection.

Optionally, the sheet that is folded may have perforation to facilitate the folding operation. As also shown in FIG. 7, extending from the folded projection 726 are two pivotable plates 728*a* and 728*b*. The two pivotable plates, together with the section 729 of the front surface of the projection 726 extending from the plate 712, define a passage into which the side edge 740*b* of the second IDT 730 is received when the IDT's 710 and 730 are directed into their mated configuration. The two pivotable plates 728*a* and 728*b* can be biased towards the section 729 such that they exert a force on the portion of the IDT 730 near side edge 740*b* that is received in the passage, thereby maintaining the IDT's 710 and 730 in a stable mechanical contact. Accordingly, the folded projection 726 is used not only to form an electrical connection between the IDS 700 and another electrical contact, but also to define a passage that helps form a stable mechanical formation between the two IDT's 710 and 730.

In operation, the IDT 730 is directed into mating configuration with the IDT 710 by guiding the second edge 736 into the passage defined by the rolled rail fastener 720 and the passage defined by pivotable plates 728*a* and 728*b*. To insert the second edge 736 into the passage formed in the IDT 710 some degree of force may be required to overcome the biasing force exerted by the rolled rail fastener and the pivotable plates. The IDT 730 is then displaced so that its second edge 736 moves towards the base edge 714 of the first IDT 710.

An electrical cable (not shown) is placed in the closed adjustable aperture defined by the two opposing slots of the displaced IDT's 710 and 730. The two IDT's may then continue moving towards each other until the slots 718 and 738 slice the insulation of the cable and establish an electrical connection between the IDS 700 and the cable. When the two IDT's 710 and 730 have reached their final mated position, the mechanical forces exerted by the rolled rail fastener 720 and pivotable plates 728*a* and 728*b* on the IDT 730 maintain the IDT's 710 and 730 in a secure mechanical contact. The projection 726 is then connected to the electrical contact to establish the electrical connection between the cable placed in the closed adjustable aperture defined by the slots 718 and 738 and the electrical contact.

OTHER EMBODIMENTS

A number of embodiments of the invention have been described. Nevertheless, it will be understood that various modifications may be made without departing from the spirit and scope of the invention. For example, in some embodiments, the plate 112 of the first IDT 110 and/or the plate 132 of the second IDT 130 may have a circular configuration, or may have other shapes, configurations and dimensions. Further, in some embodiments; only part of the plate 112, and/or the plate 132, may be composed of an electrically conducting material in a manner sufficient to establish an electrical path between the conductor of the cable 102 and the electrical contact. Accordingly, other embodiments are within the scope of the following claims.

What is claimed is:

1. An insulation-displacement system comprising:

a first insulation-displacement terminal (IDT) and a second IDT, the first IDT adapted to receive in a mating configuration the second IDT, each of the first and second IDT comprising an associated plate that includes:

a base edge, and a slot configured to receive an electrical conductor surrounded by an insulator and displace the insulator, wherein the slot extends towards the center of the associated plate from a second edge located opposite the base edge.

2. The insulation-displacement system of claim 1 wherein the surface of the plate of the first IDT is placed substantially adjacent to the surface of the plate of the second IDT, and wherein the second edge of the second IDT is displaceable towards the base edge of the first IDT.

3. The insulation-displacement system of claim 1, wherein the second edge of each plate of each of the IDT's is V-shaped, and wherein each slot extends from the respective V-shaped edge.

4. The insulation-displacement system of claim 1, wherein the slot of the first IDT and the slot of the second IDT are substantially adjacent such that the slots define a closed adjustable aperture configured to hold the electrical conductor.

5. The insulation-displacement system of claim 1, wherein the plate of the second IDT further includes two substantially flat side edges, and wherein the plate of the first IDT further includes two side edges formed to define tracks configured to receive the respective side edges of the second IDT.

6. The insulation-displacement system of claim 5, wherein the formed side edges of the first IDT are curved inwardly.

7. The insulation-displacement system of claim 1, wherein each plate of each of the IDT's further includes an arc-shaped rib configured to prevent slot deformation.

8. The insulation-displacement system of claim 1, wherein each plate of each of the IDT's is substantially entirely constructed from an electrical conductive material.

9. The insulation-displacement system of claim 1, wherein each of the IDT's further includes a projection extending from the plate of the corresponding IDT, the projection configured to electrically couple the corresponding IDT to an electrical contact.

10. The insulation-displacement system of claim 9, wherein the projection of each of the IDT's is a blade that extends in a direction that is substantially perpendicular to surface of the corresponding plate.

11. The insulation-displacement device of claim 10, wherein the surfaces of the respective blades of the first IDT and the second IDT are positioned adjacent to each other such that the adjacently placed blades define a resultant blade having a thickness that is substantially the sum of the thickness of the respective blades of the first IDT and the second IDT.

12. The insulation-displacement system of claim 11, wherein the resultant blade is configured to be received in an electrically conducting socket.

13. The insulation-displacement system of claim 12, wherein the socket is coupled to a crimp connector.

14. The insulation-displacement system of claim 12, wherein the socket comprises a female fastener configured to maintain the resultant blade within the socket.

15. The insulation displacement system of claim 1, wherein the first IDT further comprises a folded blade extending from the first plate, the folded blade comprising at least one pivotable plate extending from an end of the blade proximate to the first plate such the at least one pivotable plate and the first plate define a passage for receiving a side edge of the second plate of the second IDT.

16. The insulation-displacement system of claim 1, wherein the first IDT further includes a rolled receiver configured to fixture and lock the second IDT.

17. The insulation displacement system of claim 1 wherein the electrical conductor includes a bundle of conductors, and wherein the slot of the first IDT and the slot of the second IDT are structured to slice through insulators of the bundle of conductors and apply compressive forces directly and circumferentially to the bundle of conductors.

18. The insulation displacement system of claim 4 wherein the adjustable aperture is configured to hold variable-size electrical conductors.

19. The insulation-displacement system of claim 2, wherein the slot of the first IDT and the slot of the second IDT define an aperture configured to prevent the electrical conductor from migrating out of the slot of the first IDT and the slot of the second IDT.

20. An electrical tap connector comprising:

a first insulation-displacement terminal (IDT) and a second IDT, the first IDT adapted to receive in a mating configuration the second IDT, each of the first and second IDT comprising:

an electrically conducting member; and a plate including:

a base edge, and a slot configured to receive a first electrical conductor and displace an insulator of the conductor, wherein the slot extends towards the center of the plate from a second edge located opposite the base edge; and an electrically conducting receiver electrically coupled to a second electrical conductor, wherein the receiver is configured to receive at least one of: the member of the first IDT, and the member of the second IDT.

21. The electrical tap connector of claim 20 wherein the surface of the plate of the first IDT is placed substantially adjacent to the surface of the plate of the second IDT, and wherein the second edge of the second IDT is displaceable towards the base edge of the first IDT.

22. The electrical tap connector of claim 20, wherein the second edge of each plate of each of the IDT's is V-shaped, and wherein each slot extends from the respective V-shaped edge.

23. The electrical tap connector of claim 20, wherein the slot of the first IDT and the slot of the second IDT are substantially adjacent such that the slots define a closed adjustable aperture configured to hold the electrical conductor.

24. The electrical tap connector of claim 20, wherein the member of each of the IDT's includes a blade that extends from the plate of the respective IDT in a substantially perpendicular direction to the surface of the plate.

25. The electrical tap connector of claim 24, wherein the surface of the blade of the first IDT is substantially parallel and adjacent to the surface of the blade of the second IDT, such that the adjacently placed blade of the first IDT and the blade of the second IDT define a resultant blade having a thickness that is substantially the sum of the thickness of the respective blades.

26. The electrical tap connector of claim 20, wherein the receiver includes a crimp connector comprising a socket that is electrically and mechanically coupled to a crimp barrel.

27. The electrical tap connector of claim 26, wherein the crimp connector is configured to receive and create an electrical contact with the second electrical conductor.

* * * * *